US006695685B2

(12) United States Patent
Stratford et al.

(10) Patent No.: US 6,695,685 B2
(45) Date of Patent: Feb. 24, 2004

(54) LOW FLOW RATE NOZZLE SYSTEM FOR DRY ICE BLASTING

(75) Inventors: Scott M. Stratford, Alta Loma, CA (US); Robert S. Anderson, Whittier, CA (US)

(73) Assignee: CAE Alpheus, Inc., Rancho Cucamonga, CA (US)

( * ) Notice: Subject to any disclaimer, the term of this patent is extended or adjusted under 35 U.S.C. 154(b) by 294 days.

(21) Appl. No.: 09/975,908

(22) Filed: Oct. 12, 2001

(65) Prior Publication Data

US 2003/0073392 A1 Apr. 17, 2003

(51) Int. Cl.[7] ..... B24C 7/00
(52) U.S. Cl. ..... 451/99; 451/39; 451/90
(58) Field of Search ..... 451/2, 39, 75, 451/90, 99, 102

(56) References Cited

U.S. PATENT DOCUMENTS 5,009,240 A * 4/1991 Levi ..... 134/7
5,081,799 A * 1/1992 Kirschner et al. ..... 451/40
5,601,478 A * 2/1997 Mesher ..... 451/75
6,328,631 B1 * 12/2001 Fukano et al. ..... 451/39
6,536,220 B2 * 3/2003 Visaisouk ..... 62/71

FOREIGN PATENT DOCUMENTS

JP 2002079465 A * 3/2002 ..... B24C/1/00

* cited by examiner

*Primary Examiner*—Joseph J. Hail, III
*Assistant Examiner*—David B Thomas
(74) *Attorney, Agent, or Firm*—Frost Brown Todd LLC

(57) ABSTRACT

A dry ice blasting system adapted for low gas flow rates at low pressures with small dry ice particles to produce a very small footprint on a surface being cleaned.

10 Claims, 1 Drawing Sheet

LOW FLOW RATE NOZZLE SYSTEM FOR DRY ICE BLASTING

FIELD OF THE INVENTION

A system enabling a small focused footprint of small dry ice particles to be directed onto a surface to be cleaned by a dry ice blasting stream at a low rate of gas flow.

BACKGROUND OF THE INVENTION

Dry ice blasting involves the generation and discharge of a blasting stream consisting of dry ice particles and a carrier stream of a gas under pressure. The gas is usually air, although other gases such as nitrogen, carbon dioxide, and argon may be used instead.

The particle sizes of dry ice employed for various cleaning tasks extend from large pellets to small particles such as shavings. The selection depends in large part on the desired energy of impact, and of the ability of the surface being cleaned to resist the impact of the particles. A delicate article can be cleaned with very small particles, but could be destroyed by larger ones.

Dry ice blasting with small particles is known, but for reasons to be described, they have never before been utilized to provide a very closely held, tightly focused, small diameter impact pattern. This in large part is due to the wide range of sizes customarily produced in a single sample of particles, plug the nozzle, bringing the process to a halt. Accordingly, when cleaning with small particles, existing nozzles and apparatus appropriate to heavy cleaning tasks were used, often inefficiently, and never with small patterns and small nozzles.

These prior devices often were undesirable neighbors operating in the pressure range between about 50 to 300 psi, and with volumes at 100 psi of perhaps 100–250 cfm. These are very loud systems, often 100–130 dbA, and very power hungry. At 100 psi a typical dry ice blasting machine that consumes at least 150 cfm requires a 40–50 horsepower compressor.

Such apparatus is poorly suited for precision cleaning of delicate areas, such as in mold cavities with restricted access. The full advantages of dry ice blasting have not been available for such applications until now. In fact, it was possible to clean these areas only with great inconvenience.

It is an object of this invention to provide a useful, finely focused beam of a blasting stream with small particles, with an order of magnitude less of air and remarkably reduced noise. For example, a nozzle operating at 75 psi can consume as little as 4 cfm, from a one horsepower compressor. The noise can readily be reduced to about 80–90 dbA. The ability to focus a useful beam of this stream on a small delicate area opens an entirely new field of usage for the basic dry ice blasting process.

BRIEF DESCRIPTION OF THE INVENTION

A low flow nozzle receives and discharges a stream of dry ice particles in a carrier stream of gas. The gas is derived from a pressure source at a regulated rate. The dry ice is generated by a particle generator which produces a supply of granules substantially lacking in sizes above an upper limit, and at a rate respective to a desired mass ratio of air to dry ice particles.

The blasting stream passes through a discharge orifice whose cross section dimensions are related to the nominal size of the particles so that plugging the orifice is unlikely.

According to the preferred embodiment of the invention, the nominal size of the particles is no greater than about 0.035 inches in diameter, and their weight less than about 0.00016 ounces. Also, the mass ratio of air to dry ice is preferably between about 6:1 and about 1:1, and the rate of air flow is about 2–40 cfm. These are optimum relationships to produce a small footprint, perhaps as small as 0.125 inches diameter.

The above and other features of this invention will be fully understood from the following detailed description and the accompanying drawings, in which:

DETAILED DESCRIPTION OF THE INVENTION

Figure 1:
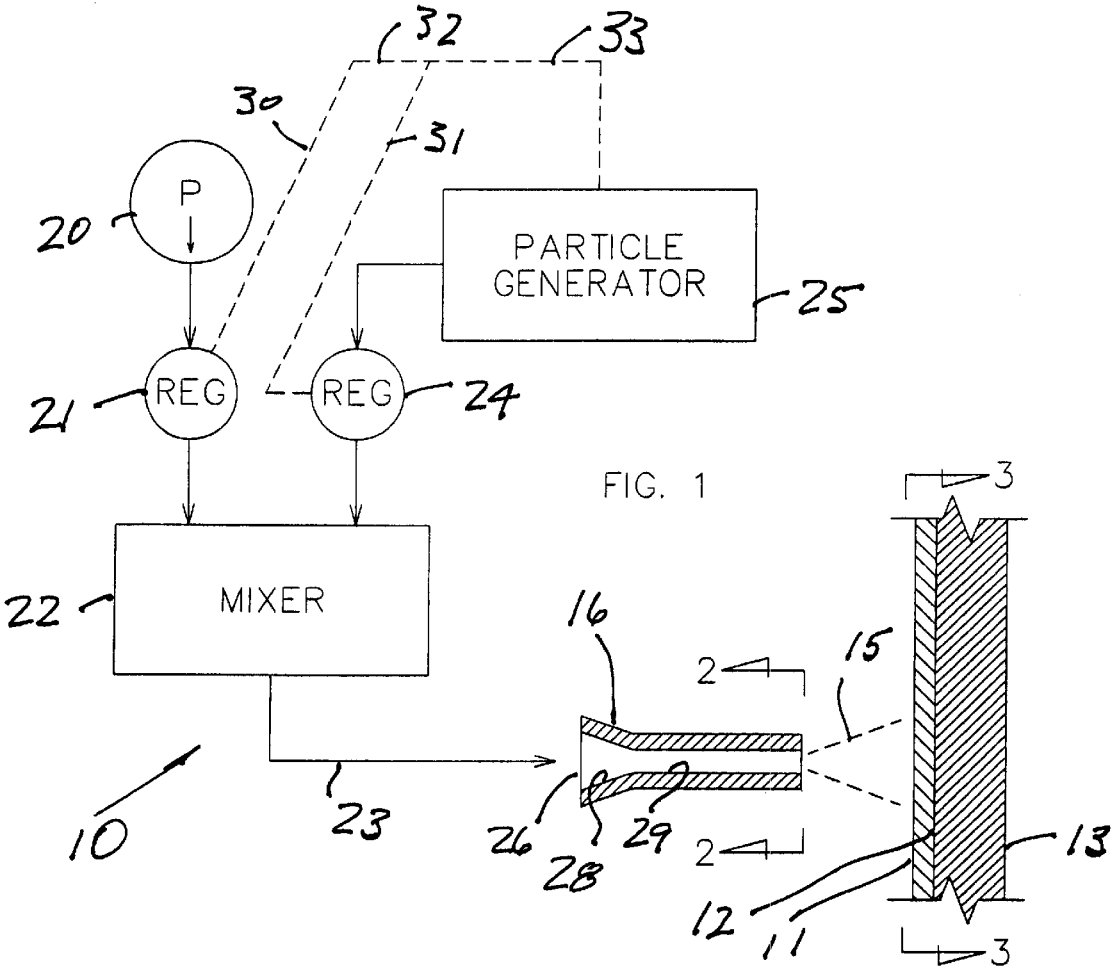
FIG. 1 is a schematic view of the presently-preferred embodiment of this invention.
Figure 2:
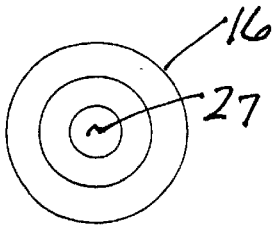
FIG. 2 is an end view taken at line 2—2 in FIG. 1.
Figure 3:
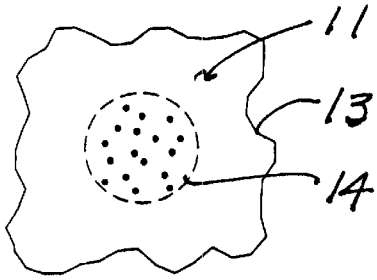
FIG. 3 is a side view taken at line 3—3 in FIG. 1.

The presently preferred system 10 according to this invention is intended to clean an undesired substance 11 from surface 12 of a work piece 13. FIG. 3 shows an intended focused footprint 14 of the emission 15 from a nozzle 16.

Carrier gas under pressure is derived from a pressure source 20 such as a compressor or a tank of stored liquified gas, as desired. Although air is the most frequently used gas, gassified liquid nitrogen, carbon dioxide or argon are other examples. Much depends on the convenience of the source. Most often this system will utilize a compressor and air rather than a cryogenic tank.

A flow regulator 21 establishes the rate of flow of the gas. The regulated gas is supplied to a mixer 22, whose purpose is to combine the pressurized gas and dry ice particles and thereby provide a blasting stream to hose 23.

Dry ice particles are supplied to the mixer at a rate determined by a regulator 24 that regulates the output of a particle generator 25. The mixed stream is presented to the entry port 26 of nozzle 16. Nozzle 16 has a circularly sectioned orifice 27, with an initial converging section 28, and a diverging section 29. The divergence can be quite small, perhaps 1½ degrees half conical angle.

The nozzle is so proportioned as to produce a footprint between about 0.125 inches and 0.50 inches in diameter for precision cleaning with small particles at low flow rates. Speaking generally, for applications of this invention, the minor dimensions (or diameter) of the small end of the converging section should not be less than 1½ times the diameter of the particles. This portion of the nozzle may be thought of as the "throat"

The regulators are respectively set or controlled to establish the relative rates of supply of gas and solids. They are adapted to deliver air and dry ice in relative mass ratios between about 6:1 and about 1:1 which will entrain and suitably deliver particles of the sizes intended to be used. Regulator 24 may if desired be slaved to regulator 21 to maintain a selected ratio.

A suitable type of particle generator shaves particles from a block of dry ice. A particle generator able to make such small particles is available from CAE Alpheus, Inc.

This particle generator has the ability to deliver particles substantially without sizes larger than about 0.035 inches in diameter, with few fines and with substantially no oversized particles which could themselves plug a small bore nozzle, or which could combine with smaller particles to form a glob that would plug the small nozzle. In fact, the fines tend to sublimate sooner than the larger particles, and are of no concern to the invention. However, oversize particles may not only lead to plugging of the small nozzle orifices used in this invention but also may damage a delicate target. The mass of the particles will be less than 0.00016 ounces each.

In the operation of this system, the desired air flow rate at the established pressure is set by regulator 21, acting as a flow meter or other device which responds to condition respective to flow rates.

In turn, as shown by schematic lines 30, 31 and 32, regulator 24 is slaved to regulator 21 to cause the particle generator to produce an appropriate amount of particles which, when added to the gas stream with the desired gas/dry ice ration. Line 33 indicates the control of the particle generator by regulator 24.

Accordingly, with appropriate slow flow of gas and with suitably small particles, a small sized nozzle can be used to produce a small footprint. The usual small nozzle will ordinarily be no longer than 8 inches and have an outer diameter not much larger than a fountain pen. It can readily be employed in very small recesses.

The preferred embodiment of this invention includes the slaving of the second regulator to the first. In the event that future adjustments and applications will not require apparatus response, the two regulators may simply be set at appropriate volumes, without on-going reference to one another.

This invention is not to be limited by the embodiment shown in the drawings and described in the description, which is given by way of example and not of limitation, but only in accordance with the scope of the appended claims.

We claim:

1. A system for producing a blasting stream consisting of dry ice particles entrained in a stream of gas under pressure at a low flow rate said system comprising:

a first regulator receptive of a stream of carrier gas under pressure, adapted to maintain an output gas stream at a selected flow rate;

a second regulator receptive of a sequence of dry ice particles, adapted to maintain said sequence at a regulated mass rate;

said second regulator being independently adjusted so as to produce particles at such a rate as to fulfill the dry ice requirement for a selected gas/dry ice ratio;

a mixer combining the air and dry ice particles from said regulators to create a blasting stream with the selected ratio;

a hose receiving the blasting stream from said mixer; and a nozzle attached to said hose, said nozzle having an orifice with an open cross-section from which the blasting stream is discharged;

said orifice being so configured as to receive and pass said stream without plugging when the diameter of said particles is about 0.035 inches or less, and the flow rate in the regulator is between about 2 and about 40 cfm, at about 100 psi.

2. A system according to claim 1 in which said nozzle includes a converging section and a diverging section, the converging section receiving the stream from the hose.

3. A system according to claim 1 in which substantially none of the dry ice particles exceeds about 0.035 inches in diameter.

4. A system according to claim 1 in which said nozzle orifice is circular.

5. A system according to claim 1 in which the diameter of the major proportion of the particles is about 0.035 inches, and in which the flow rate at 100 psi is about 6 cfm.

6. A system according to claim 1 in which said second regulator is slaved to said first regulator continually to produce particles appropriate to conditions established by said first regulator.

7. A system according to claim 6 in which said nozzle includes a converging section and a diverging section, the converging section receiving the stream from the hose.

8. A system according to claim 6,in which substantially none of the dry ice particles exceeds about 0.035 inches in diameter.

9. A system according to claim 6 in which said nozzle orifice is circular.

10. A system according to claim 6 in which the diameter of the major proportion of the particles is about 0.035 inches, and in which the flow rate at 100 psi is about 6 cfm.

* * * * *